US010568389B1

(12) United States Patent
Lin

(10) Patent No.: US 10,568,389 B1
(45) Date of Patent: Feb. 25, 2020

(54) SHOELACE

(71) Applicant: JING HUNG LIANG LTD., Changhua County (TW)

(72) Inventor: Ping-Kun Lin, Changhua County (TW)

(73) Assignee: JING HUNG LIANG LTD., Changhua County (TW)

( * ) Notice: Subject to any disclaimer, the term of this patent is extended or adjusted under 35 U.S.C. 154(b) by 0 days.

(21) Appl. No.: 16/201,591

(22) Filed: Nov. 27, 2018

(51) Int. Cl.
*A43C 9/00* (2006.01)
*D03D 3/02* (2006.01)

(52) U.S. Cl.
CPC ..... *A43C 9/00* (2013.01); *D03D 3/02* (2013.01); *D10B 2331/04* (2013.01); *D10B 2331/10* (2013.01); *D10B 2401/00* (2013.01)

(58) Field of Classification Search
CPC ..... A43C 9/00; D03D 3/02
See application file for complete search history.

(56) References Cited

U.S. PATENT DOCUMENTS

2008/0300602 A1* 12/2008 Schmitt ..... A61B 17/8816 606/93
2012/0144631 A1* 6/2012 Stanev ..... A43C 1/02 24/715.3
2012/0165918 A1* 6/2012 Du ..... A61F 2/06 623/1.15
2013/0255045 A1* 10/2013 Gonzalez ..... A43C 9/00 24/715.3
2013/0260104 A1* 10/2013 Dua ..... B32B 5/02 428/175
2016/0122918 A1* 5/2016 Tam ..... D07B 1/025 87/8

FOREIGN PATENT DOCUMENTS

| | | | |
|---|---|---|---|
| TW | 479474 | U | 3/2002 |
| TW | M240854 | U | 8/2004 |
| TW | M253245 | U | 12/2004 |
| TW | M337982 | U | 8/2008 |
| TW | M339939 | U | 9/2008 |
| TW | M349209 | U | 1/2009 |
| TW | M421015 | U | 1/2012 |
| TW | M447117 | U | 2/2013 |
| TW | M521914 | B | 5/2016 |
| TW | I539907 | U | 7/2016 |
| TW | M529401 | U | 10/2016 |
| TW | I611774 | B | 1/2018 |
| TW | M394015 | U | 12/2018 |

* cited by examiner

*Primary Examiner* — Robert Sandy
*Assistant Examiner* — David M Upchurch
(74) *Attorney, Agent, or Firm* — Muncy, Geissler, Olds & Lowe, PC

(57) ABSTRACT

A shoelace includes a tubular body woven by first threads, second threads, third threads, and fourth threads. Each first thread and each second thread are made of TPU. Each third thread and each fourth thread are made of polyester. Each first thread and each third thread are left-handed helices. Each second thread and each fourth thread are right-handed helices. Each first thread is parallel to each third thread. Each second thread is parallel to each fourth thread. The first threads and the third threads are alternately arranged. The second threads and the fourth threads are alternately arranged and are woven with the first threads and the third threads. Each first thread and each second thread have a smaller denier than that of each third thread and each fourth thread.

8 Claims, 2 Drawing Sheets

SHOELACE

BACKGROUND OF THE INVENTION

Field of the Invention

The present invention relates to a shoelace.

Description of the Prior Art

A conventional shoelace is easy to slip. To solve the problem, shoelaces in special structures are developed.

The most common anti-slipping shoelace has different diameters, such as patents TW 1611774, TW M529401, TW M447117, TW M421015, TW M394015, TW M349209, TW M339939, TW M337982, TW M253245, TW M240854, and TW 479474. However, this structure is difficult to manufacture and has a bad appearance. In addition, the shoelace is difficult to insert through the eyelets of shoes. Besides, the shoelace has to be knotted at the smaller-diameter portions.

Another kind of anti-slipping shoelace is shown in patents TW 1539907 and TW M521914. A core having different diameters is inserted through an outer tube. The outer tube has much space for deformation at the smaller-diameter portions of the core. Though the appearance of the shoelace is improved, the core is still difficult to manufacture. In addition, the core has to be inserted into the outer tube to make the manufacturing process complicated.

SUMMARY OF THE INVENTION

The main object of the present invention is to provide a shoelace which is aesthetic, easy to extend, and anti-slipping.

To achieve the above and other objects, the shoelace of the present invention includes a tubular body woven by at least four first threads, at least four second threads, at least four third threads, and at least four fourth threads. The tubular body defines an axial direction. Each of the first threads and each of the second threads are made of TPU (Thermoplastic polyurethanes). Each of the third threads and each of the fourth threads are made of polyester. Each of the first threads is a left-handed helix. Each of the second threads is a right-handed helix. Each of the third threads is a left-handed helix. Each of the fourth threads is a right-handed helix. Each of the first threads is parallel to each of the third threads. Each of the second threads is parallel to each of the fourth threads. The first threads and the third threads are alternately arranged. The second threads and the fourth threads are alternately arranged and are woven with the first threads and the third threads. Each of the first threads and each of the second threads have a smaller denier than that of each of the third threads and each of the fourth threads.

DETAILED DESCRIPTION OF THE PREFERRED EMBODIMENTS

Figure 1:
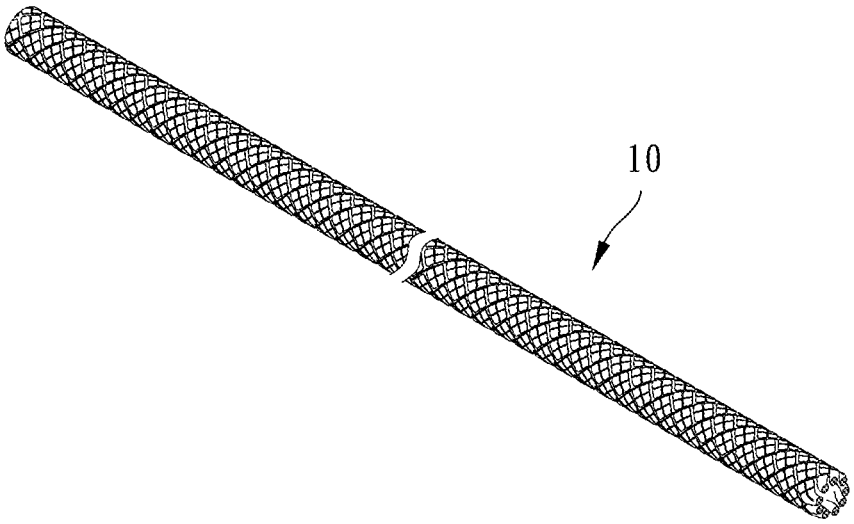
FIG. 1 is a stereogram of the present invention.
Figure 2:
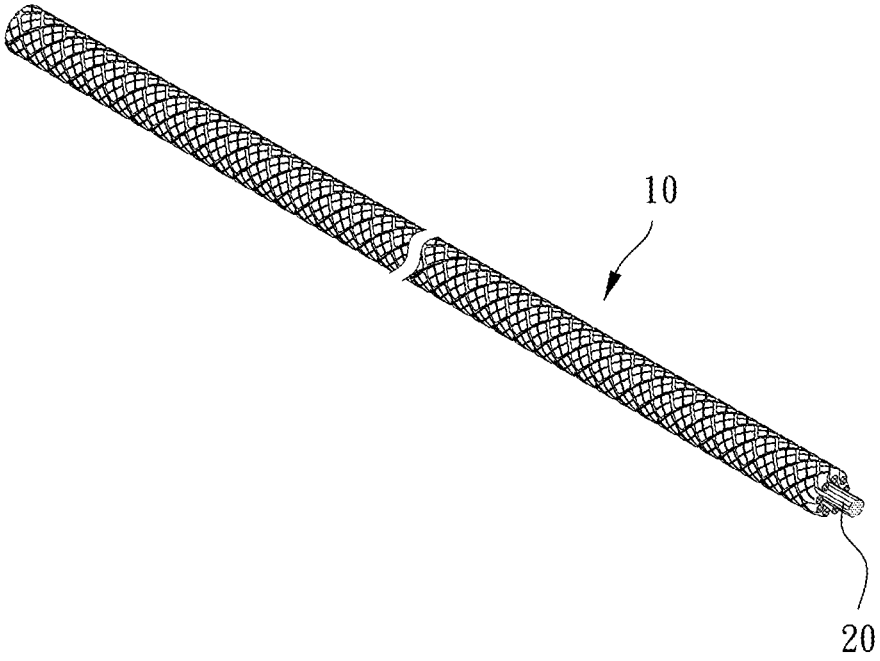
FIG. 2 is a stereogram showing a second embodiment of the present invention.
Figure 3:
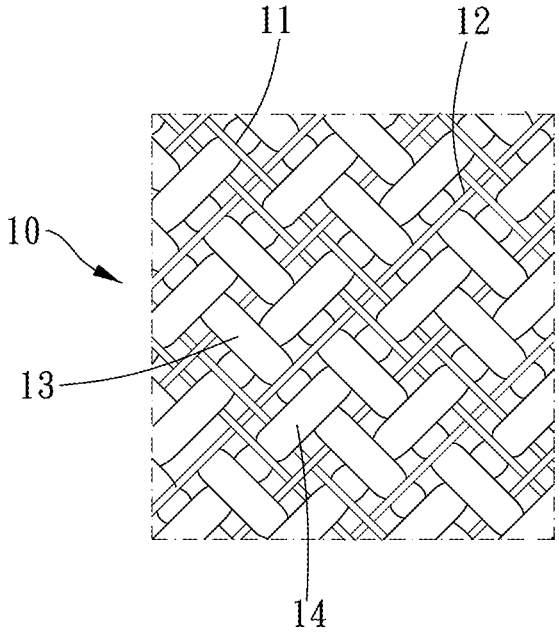
FIG. 3 is a partial enlargement of a tubular body of the present invention.

Please refer to FIG. 1 to FIG. 3, the shoelace of the present invention includes a tubular body 10 woven by at least four first threads 11, at least four second threads 12, at least four third threads 13, and at least four fourth threads 14. The tubular body 10 defines an axial direction. Each of the first threads 11 and each of the second threads 12 are made of TPU (Thermoplastic polyurethanes). Each of the third threads 13 and each of the fourth threads 14 are made of polyester. Each of the first threads 11 is a left-handed helix 1. Each of the second threads 12 is a right-handed helix. Each of the third threads 13 is a left-handed helix. Each of the fourth threads 14 is a right-handed helix. Each of the first threads 11 is parallel to each of the third threads 13. Each of the second threads 12 is parallel to each of the fourth threads 14. The first threads 11 and the third threads 13 are alternately arranged. The second threads 12 and the fourth threads 14 are alternately arranged and are woven with the first threads 11 and the third threads 13. Each of the first threads 11 and each of the second threads 12 have a smaller denier than that of each of the third threads 13 and each of the fourth threads 14. In other possible embodiment, the shoelace can further include a core 20 inserted through the tubular body 10 and extending along the axial direction, as shown in FIG. 2.

In the present embodiment, each of the first threads 11 and each of the second threads 12 have a same denier, and each of the third threads 13 and each of the fourth threads 14 have a same denier. An external diameter of each of the first threads 11 and each of the second threads 12 is equal to or smaller than one fifth an external diameter of each of the third threads 13 and each of the fourth threads 14. Preferably, each of the first threads 11 is 300 denier. Each of the second threads 12 is 300 denier. Each of the third threads 13 is 1200 denier. Each of the fourth threads 14 is 1200 denier. Besides, when the tubular body 10 is observed in extension along a circumferential direction, an angle between each of the first threads 11 and the axial direction is −45 degrees, an angle between each of the third threads 13 and the axial direction is −45 degrees, an angle between each of the second threads 12 and the axial direction is +45 degrees, and an angle between each of the fourth threads 14 and the axial direction is +45 degrees.

On the other hand, at least one of the first thread 11 is located between each of the third threads 13 and an adjacent third thread 13 at a side. The first threads 11 are absent between each of the third threads 13 and an adjacent third thread 13 at another side. That is, several pairs of the third threads 13 have no first thread 11 therebetween so that the two third threads 13 look protruded. In addition, the second threads 12 and the third threads 13 have different denier and diameter, so the two third threads 13 and the fourth threads 14 crossing therewith look more protruded. On the contrary, the first threads 11 and the second threads 12 are difficult to identify so that the shoelace has a protruded block-shaped appearance. More specifically, when the second threads 12 extend to the rear side of the third threads 13 (the internal side of the tubular body 10), the second threads 12 are located at a center of the block unit. Thus, the two adjacent third threads 13 and the two fourth threads 14 crossing therewith form a protruded block unit which is rhombus-shaped. The tubular body 10 has a plurality of rhombus-shaped block units arranged in alignment.

In conclusion, the protruded block units can provide a rough surface to prevent from slipping. In addition, the hollow tubular body has sufficient space for deformation to make the knot firmer. Besides, the protruded block unit is almost composed of polyester threads. Polyester is easy to color and process, so the color and the pattern of the shoelace can be easily alternated. On the other hand, the TPU threads are useful to maintain the shape and to fix the threads, and the TPU threads have smaller diameter and are recessed with respect to the polyester threads to emphasize the protruded polyester threads.

What is claimed is:

1. A shoelace, including a tubular body woven by at least four first threads, at least four second threads, at least four third threads, and at least four fourth threads, the tubular body defining an axial direction, each of the first threads and each of the second threads being made of TPU (Thermoplastic polyurethanes), each of the third threads and each of the fourth threads being made of polyester, each of the first threads being a left-handed helix, each of the second threads being a right-handed helix, each of the third threads being a left-handed helix, each of the fourth threads being a right-handed helix, each of the first threads being parallel to each of the third threads, each of the second threads being parallel to each of the fourth threads, the first threads and the third threads being alternately arranged, the second threads and the fourth threads being alternately arranged and being woven with the first threads and the third threads, each of the first threads and each of the second threads having a smaller denier than that of each of the third threads and each of the fourth threads.

2. The shoelace of claim 1, wherein each of the first threads and each of the second threads have a same denier, each of the third threads and each of the fourth threads have a same denier.

3. The shoelace of claim 1, wherein an external diameter of each of the first threads and each of the second threads is equal to or smaller than one fifth an external diameter of each of the third threads and each of the fourth threads.

4. The shoelace of claim 1, wherein at least one of the first threads is located between each of the third threads and an adjacent third thread at a side, the first threads are absent between each of the third threads and an adjacent third thread at another side.

5. The shoelace of claim 4, wherein at least two of the first threads is located between each of the third threads and an adjacent third thread at a side.

6. The shoelace of claim 1, wherein when the tubular body is observed in extension along a circumferential direction, an angle between each of the first threads and the axial direction is −45 degrees, an angle between each of the third threads and the axial direction is −45 degrees, an angle between each of the second threads and the axial direction is +45 degrees, an angle between each of the fourth threads and the axial direction is +45 degrees.

7. The shoelace of claim 1, wherein each of the first threads is 300 denier, each of the second threads is 300 denier, each of the third threads is 1200 denier, each of the fourth threads is 1200 denier.

8. The shoelace of claim 1, further including a core, the core being inserted through the tubular body and extending along the axial direction.

* * * * *